US005742312A

United States Patent [19]

Carlotta

[11] Patent Number: 5,742,312

[45] Date of Patent: Apr. 21, 1998

[54] PRINTHEAD CARTRIDGE HAVING A FLUID VALVED BREATHER

[75] Inventor: Michael Carlotta, Sodus, N.Y.

[73] Assignee: Xerox Corporation, Stamford, Conn.

[21] Appl. No.: 807,857

[22] Filed: Feb. 26, 1997

Related U.S. Application Data

[63] Continuation of Ser. No. 333,704, Nov. 3, 1994, abandoned.

[51] Int. Cl.[6] ..... B41J 2/175

[52] U.S. Cl. ..... 347/87

[58] Field of Search ..... 347/84, 85, 86, 347/87, 92

[56] References Cited

U.S. PATENT DOCUMENTS

| | | | |
|---|---|---|---|
| 4,571,599 | 2/1986 | Rezanka | 346/140 |
| 4,791,438 | 12/1988 | Hanson et al. | 346/140 |
| 4,794,409 | 12/1988 | Cowger et al. | 346/140 |
| 4,929,969 | 5/1990 | Morris | 346/140 |
| 4,994,824 | 2/1991 | Winslow | 346/140 |
| 5,010,354 | 4/1991 | Cowger et al. | 346/140 |
| 5,138,332 | 8/1992 | Carlotta | 347/92 |
| 5,182,581 | 1/1993 | Kashimura et al. | 346/140 |
| 5,216,450 | 6/1993 | Koitabashi et al. | 346/140 |
| 5,233,369 | 8/1993 | Carlotta et al. | 346/140 |
| 5,289,212 | 2/1994 | Carlotta | 346/140 |
| 5,448,274 | 9/1995 | Hirabayashi et al. | 347/86 |
| 5,453,771 | 9/1995 | Waseda et al. | 347/86 |
| 5,509,140 | 4/1996 | Koitabashi et al. | 347/86 |

FOREIGN PATENT DOCUMENTS

| | | | |
|---|---|---|---|
| 493058-A2 | 7/1992 | European Pat. Off. | 347/87 |
| 562733-A2 | 9/1993 | European Pat. Off. | 347/87 |

*Primary Examiner*—Benjamin R. Fuller
*Assistant Examiner*—Judy Nguyen
*Attorney, Agent, or Firm*—Daniel J. Krieger

[57] ABSTRACT

An ink jet printhead cartridge having a fluid valved breather. The ink jet printhead cartridge includes a housing having an air inlet, an ink outlet, a first chamber, and a second chamber. The first chamber contains a supply of ink and is substantially free of ink-retaining foam. The second chamber includes an ink-retaining foam which saturates with ink for supply to an ink jet printhead. An air transfer passageway connects the first chamber to the second chamber so that air pressure affects the level of ink in the first chamber thereby maintaining a level of ink in the second chamber sufficient for supplying ink to the ink jet printhead.

13 Claims, 4 Drawing Sheets

PRINTHEAD CARTRIDGE HAVING A FLUID VALVED BREATHER

This application is a continuation of application Ser. No. 08/333,704 filed Nov. 3, 1994, now abandoned.

FIELD OF THE INVENTION

This invention relates generally to a liquid ink printing apparatus and more particularly to a system for supplying liquid ink to a printhead in an ink jet printer.

BACKGROUND OF THE INVENTION

An ink jet printer of the so-called drop on demand type has at least one printhead from which droplets of ink are directed towards a recording medium. Within the printhead the ink is contained in a plurality of channels in which energy pulses are used to cause the droplets of ink to be expelled, as required, from orifices or nozzles at the end of the channels.

In a thermal ink-jet printer, the energy pulses are usually produced by resistors, each located in a respective one of the channels and individually addressable by current pulses to heat and vaporize ink in the channels. A thermal energy generator, usually a resistor, is located in each of the channels, a predetermined distance from the nozzles. The resistors are individually addressed with a current pulse to momentarily vaporize the ink thereby forming a bubble which expels an ink droplet. As the bubble grows, the ink which bulges from the nozzles is contained by the surface tension of the ink as a meniscus. As the bubble begins to collapse, the ink remaining in the channel between the nozzle and the bubble moves towards the collapsing bubble, causing a volumetric contraction of the ink at the nozzle resulting in the separation of the bulging ink as a droplet. The acceleration of the ink out of the nozzle while the bubble is growing provides the momentum and velocity of the droplet in a substantially straight line direction towards the recording medium. Because the droplet of ink is emitted only when the resistor is actuated, this type of thermal ink jet printing is known as drop-on-demand printing. The channel is then refilled by capillary action which, in turn, draws ink from a supply container. Operation of a thermal ink jet printer is described in, for example, U.S. Pat. No. 4,849,774.

One particular form of thermal ink jet printer is described in U.S. Pat. No. 4,638,337. The described printer is of the carriage type and has a plurality of printheads each having its own ink supply cartridge mounted on a reciprocating carriage. The nozzles in each printhead are aligned perpendicularly to the line of movement of the carriage and a swath of information is printed on the stationary recording medium as the carriage is moved in one direction. The recording medium is then stepped perpendicularly to the line of carriage movement by a distance equal to the width of the printed swath. The carriage is then moved in the reverse direction to print another swath of information. Full width or page width linear arrays, in which the sheet is moved past a linear array of nozzles extending across the full width of the sheet, are also known.

In current practical embodiments of drop-on-demand thermal ink jet printers it has been found that such printers work most effectively when the pressure of the ink at the printhead nozzle is kept within a predetermined range of gauge pressures. During operation, when an individual nozzle or an entire printhead is not actively emitting droplets of ink, it is important that a certain negative pressure or back pressure exists in each of the nozzles, and by extension, within the ink supply manifold of the printhead. A discussion of desirable ranges for back pressure in thermal ink jet printing appears in the *Xerox Disclosure Journal,* Vol. 16, No. 4, July/August 1991, page 233. The back pressure prevents unintended leakage or weeping of liquid ink from the nozzles onto the recording surface. Such weeping obviously affects copy quality if liquid ink leaks from the printhead uncontrollably.

The ink supply cartridge is typically a prepackaged, usually disposable item, having a sealed container holding a supply of ink and having attached thereto a printhead with a linear or matrix array of nozzles. The printhead is either permanently attached to the cartridge, in which case, the entire printhead/cartridge is disposed of, or the cartridge is without a permanent printhead, in which case, the cartridge is disposed by itself. Generally, the cartridge includes terminals to interface with an electronic controller of the printer; electronic parts in the cartridge itself are associated with the ink channels in the printhead, such as the resistors and any electronic temperature sensors, as well as digital means for converting incoming signals for imagewise operation of the heaters. Typically, cartridges are purchased as needed by the consumer and used either until the supply of ink is exhausted or until the amount of ink in the cartridge becomes insufficient to maintain the back pressure of the ink to the printhead within the usable range. Consequently, an ink cartridge should be designed to maintain the back pressure within the usable range over as large a proportion of the total range of ink levels in the cartridge as possible. Failure to maintain back pressure can cause ink in the cartridge to leak out through the printhead nozzles or can cause ingestion of air into the nozzles at the end of the cartridges useful life thereby causing print problems.

One type of liquid ink cartridge sold by Canon for the printer BJ-600C includes two chambers. A first chamber which includes a supply of liquid ink is separated by a vertical wall having vertical grooves in contact with a second chamber filled with foam. A lower port connects the first chamber to the second chamber. The second chamber is coupled to a printhead and as ink is expelled from the printhead nozzles, ink is absorbed by the foam located in the second chamber from ink located in the first chamber. Once the ink level in the foam contained in the second chamber is reduced to a certain point due to printing, the vertical grooves become exposed to air as the foam desaturates. The foam absorbs ink from the first chamber, causing the air above the ink in the first chamber to be decreased in pressure. The right combination of foam saturation and negative pressure above the ink draws the air in through the grooves, thus displacing the absorbed ink and reaching equilibrium. This type of cartridge is known as a "bubbler".

Other ink supply cartridges for supplying ink to an ink jet printhead are illustrated and described in the following disclosures, which may be relevant to certain aspects of the present invention.

U.S. Pat. No. 4,571,599 to Rezanka describes an ink cartridge for an ink jet printer having a hermetically sealed main-ink reservoir which contains an ink supply at a negative pressure. A secondary reservoir holds an air pocket at atmospheric pressure and releases air into the main reservoir as required to maintain the desired negative pressure to the printhead nozzles. A passageway provides ink from the main reservoir to the printhead nozzles.

U.S. Pat. No. 4,791,438 to Hanson et al. describes an ink jet printer having an ink supply housing which includes a primary ink reservoir and a secondary ink reservoir. A capillary tube positioned within the ink supply housing includes an ink flow path which extends between the primary ink reservoir and the secondary ink reservoir to maintain back pressure for the printhead.

U.S. Pat. No. 4,794,409 to Cowger et al. describes an ink jet pen having a primary and a secondary ink reservoir and an ink jet printhead all interconnected by way of a porous ink transfer member. Ink passes directly from the primary ink reservoir to the printhead under certain conditions but under other conditions a secondary reservoir is brought into operation to give or receive ink to or from the porous ink transfer member to maintain a back pressure.

U.S. Pat. No. 4,929,969 to Morris describes an ink reservoir for drop-on-demand ink-jet printing with printhead components. The ink reservoir includes a housing defining an ink storage volume, a vent opening and an ink outlet coupled to a printhead. A mass of foam type material substantially fills a major portion of the housing and covers the ink outlet.

U.S. Pat. No. 4,994,824 to Winslow describes an ink jet pen having a normal speed mode and a high speed mode of operation. A bubble generator orifice introduces air from an atmospherically vented chamber into a reservoir to relieve the partial vacuum caused by ejection of ink. In high speed mode, a heater heats air trapped in the ink reservoir which pressurizes the ink and causes it to more quickly refill the ink ejecting nozzles after firing.

U.S. Pat. No. 5,010,354 to Cowger et al. describes an ink jet pen having a primary ink reservoir connected to a printhead and to a chamber containing a capillary volume element. During a normal ambient temperature and pressure range, ink from the reservoir does not enter the capillary volume element. Outside the normal range, increased pressure within the reservoir causes ink to be drawn into the capillary elements enabling the reservoir pressure to remain substantially constant.

U.S. Pat. No. 5,138,332 to Carlotta describes a printhead assembly including a printhead and an ink reservoir mounted on a scanning carriage. Ink expelled from the printhead during printing is replenished with ink drawn from the reservoir. The reservoir is connected to a supply of ink which is supplied during printing and when the printhead assembly is being primed. A partition within the reservoir insures that during priming, air is expelled from the reservoir through the printhead, thereby avoiding the need for an air vent in the reservoir.

U.S. Pat. No. 5,182,581 to Kashimura et al. describes an ink tank for storing recording ink having an ink storage section which includes an ink holding member for holding ink and a ventilation section having a vent hole communicating with the interior of the ink tank. The ink holding member can be formed of one porous member or two porous members, one of high porosity and one of low porosity. The member with high porosity is provided adjacently to an ink supply port for supplying ink to an ink jet recording head.

U.S. Pat. No. 5,216,450 to Koitabashi et al. describes an ink jet head cartridge having an area where an ink absorber is located and an air area, a part of which, is defined by a tubular member and which is filled with air.

U.S. Pat. No. 5,233,369 to Carlotta et al. describes an ink cartridge for an ink jet printer that supplies ink at a negative pressure. The ink cartridge includes a housing having an upper chamber and a lower chamber and a first wall therebetween. The lower chamber is air locked until the ink level and the upper chamber is sufficiently low to allow passage of air through the pores of a capillary foam located in the upper chamber. A printhead is located at a vertical height greater than a top level of the lower chamber.

U.S. Pat. No. 5,289,212 to Carlotta describes a cartridge for supplying liquid ink to an ink jet printing apparatus. The cartridge includes a chamber having a ventilation port and an outlet port. A medium occupies a portion of the chamber for retaining liquid ink therein at a predetermined back pressure.

U.S. patent application Ser. No. 07/885,704 entitled "Ink Supply System for a Thermal Ink Jet Printer" filed May 19, 1992, to Dietl et al. describes a system for supplying liquid ink to an ink jet printing apparatus which includes a housing defining a single chamber having a ventilation port and an outlet port, a medium occupying a portion of the chamber, and a scavenger member disposed across the outlet port providing a capillary force greater than the capillary force of the medium in the housing.

SUMMARY OF THE INVENTION

In accordance with one aspect of the invention, there is provided an ink supply cartridge having a housing defining an interior space and having an air inlet located at a first position and an ink outlet located at a second position. A member defines a first chamber with said housing, a vent inlet located at a third position, and an ink inlet wherein the vent inlet and the ink inlet communicate with the first chamber. An ink retaining member is disposed in the first chamber and receives ink from the ink inlet and releases ink to the ink outlet.

Pursuant to another aspect of the invention, there is provided an ink jet printer for printing on a recording medium having an ink supply cartridge, a frame supporting the ink supply cartridge in spaced relationship with the recording medium, and a printhead. The ink supply cartridge includes a housing defining an interior space, an air inlet located at a first position and an ink outlet located at a second position. A member defines a first chamber with the interior space of the housing, a vent inlet located at a third position, and an ink inlet, the vent inlet and the ink inlet communicating with the first chamber. An ink retaining member is disposed in the first chamber and receives ink from the ink inlet and releases ink to the ink outlet. The printhead is coupled to the ink outlet.

DETAILED DESCRIPTION OF THE INVENTION

Figure 7:
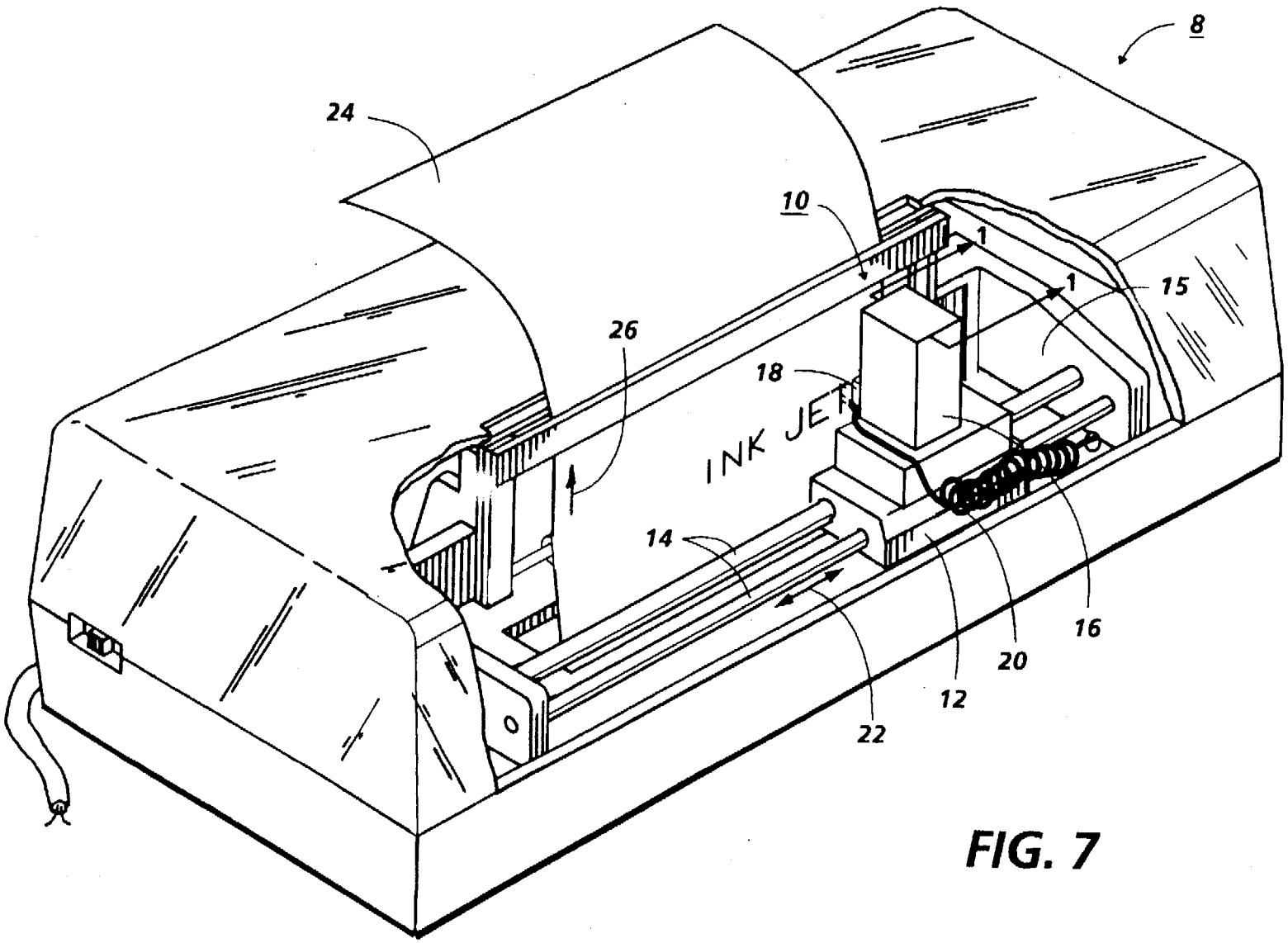
FIG. 7 illustrates a perspective view of an ink jet printer.

FIG. 7 illustrates a perspective view of an ink jet printer 8 having an ink jet printhead cartridge 10 mounted on a carriage 12 supported by carriage rails 14. The carriage rails are supported by a frame 15 of the ink jet printer 8. The printhead cartridge 10 includes a housing 16 containing ink for supply to a thermal ink jet printhead 18 which selectively expels droplets of ink under control of electrical signals received from a controller (not shown) of the printer 8 through an electrical cable 20. The printhead 18 contains a plurality of ink channels (not shown) which carry ink from the housing 16 to respective ink ejecting orifices or nozzles (also not shown). When printing, the carriage 12 reciprocates back and forth along the carriage rails 14 in the direction of the arrow 22. As the printhead cartridge 10 reciprocates back and forth across a recording medium 24, such as a sheet of paper or a transparency, droplets of ink are expelled from selected ones of the printhead nozzles towards the sheet of paper. Typically, during each pass of the carriage 12 the recording medium 24 is held stationary. At the end of each pass, however, the recording medium 24 is stepped in the direction of the arrow 26. For a more detailed explanation of the printhead and printing thereby, refer to U.S. Pat. No. 4,571,599 and U.S. Pat. No. Reissue 32,572, the relevant portions of which are incorporated herein by reference.

Figure 1:
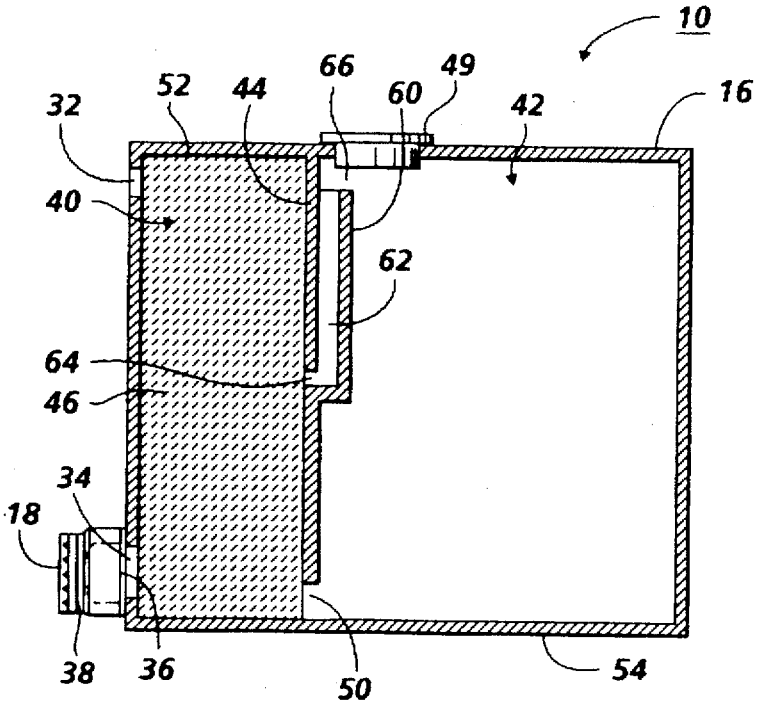
FIG. 1 is a sectional elevational view of a printhead cartridge of the present invention without ink.

FIG. 1 is a sectional elevational view of the printhead cartridge 10 along the line 1—1 of FIG. 7 which includes the housing 16 and the printhead 18 attached thereto. The printhead 18 can either be permanently attached to the cartridge 10 or can be semipermanent with the printing machine such that more than one cartridge 10 is used with a single printhead 18. The housing 16 is typically made of a lightweight but durable plastic. Housing 16 includes an air inlet 32 and an ink outlet 34. The air inlet 32 is an opening in the housing 16 which provides for the transfer of air between the interior of the housing 16 and the exterior of the housing 16. The ink outlet 34 provides for the transfer of ink contained in the ink cartridge 10 from the interior of the housing 16 to the ink jet printhead 18. The air inlet 32, while shown as being open to the atmosphere, can be covered with an air permeable seal member such as Gortex™ to prevent leakage of ink from the interior of the housing 16. The ink outlet 34 is covered with a filter 36, such as a 15 micron filter, which permits ink to flow into the ink outlet 34 but prevents any debris or foreign material from entering the printhead 18. The backside of printhead 18 is covered with a shim or plastic manifold 38 which directs ink from the ink outlet 34 into the manifolds of the printhead 18 and, consequently, to the ink ejecting orifices for ejecting ink onto the recording medium 24.

The housing 16 defines an interior space partitioned into a first chamber 40 and a second chamber 42 by a dividing member 44. The dividing member 44 extends from one side wall of the housing 16 to an opposite side wall of the housing 16 and essentially divides the housing 16 into the first chamber 40 and the second chamber 42 such that the second chamber 42 is larger than the first chamber 40.

The first chamber 40 contains an ink retaining member 46 which is typically made of a material, such as polyurethane foam, to hold liquid ink. Liquid ink 48 (See FIG. 2) stored in the second chamber 42 is transferred from the second chamber 42, which is substantially free of ink retaining material, to the ink retaining material 46 through an ink inlet or first port 50 defined by the dividing member 44. A fill port 49 allows for filling the cartridge with ink.

Figure 2:
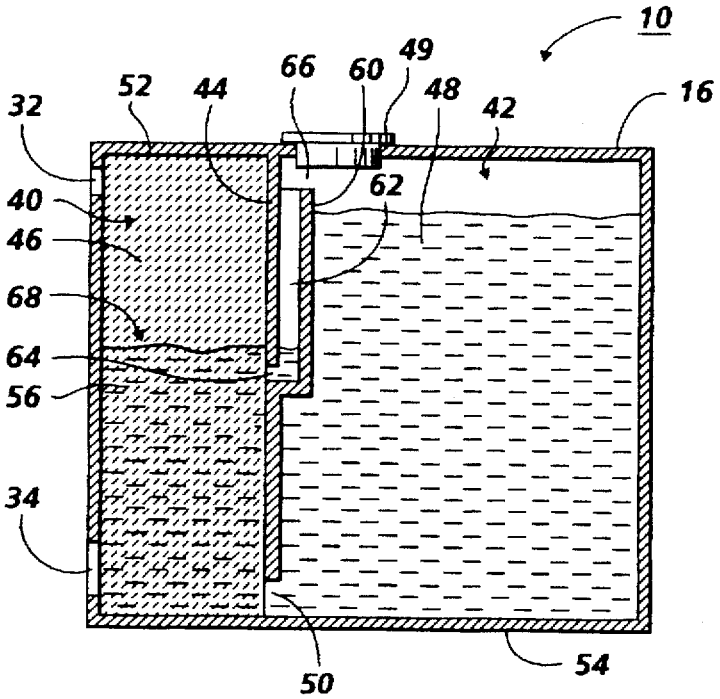
FIG. 2 is a sectional elevational view of a printhead cartridge of the present invention containing ink.

The ink retaining material 46 can be any type of foam which is typically used for retaining ink in ink jet cartridges. A suitable foam can be obtained from Illbruck, Inc. of Rochester, N.Y. having the part number 18075NY-SP. It is also possible to use needled felt. The ink retaining material 46 is packed inside the first chamber 40 in such a manner that the foam exerts reasonable contact and compression against the inner walls of the first chamber 40 and covers the air inlet 32 and ink outlet 34. As illustrated in FIG. 2, an amount ink 56, shown as a lined portion, is contained in the ink retaining member 46.

The ink 48 passes into the ink retaining material 46 from the ink inlet 50 and releases ink to the ink outlet 34 as necessary to supply the printhead 18 with ink for printing. To maintain a proper amount of ink in the ink retaining material 46 for supply to the printhead 18, the housing 16 includes a mechanism for transferring ink from the second chamber 42 to the first chamber 40 by maintaining a proper amount of air pressure above the liquid ink 48 for filling the material 46 with ink when necessary. This mechanism includes a directing member 60, which defines with the dividing member 44, an air transfer passageway 62 having a vent inlet 64 coupled to a vent outlet 66 for pressurizing the second chamber 42 to a static (no flow) condition. The directing member 60 does not extend from one sidewall to an opposite sidewall as does the dividing member 44, but is instead a member forming a vent tube having a diameter of approximately 1.6 to 2 millimeters. It is also possible to replace the directing member 60 with a separated tube spaced from the dividing member 44.

The vent inlet 64 is located a certain height, of between approximately 12.2 to 20.2 mm, above the floor 54, below the air inlet 32 and above the first port 50. The vent outlet 66, in the embodiment of FIG. 1, is located above the vent inlet 64 at a height above the top surface of the supply of ink 48 near the top of the second chamber 42. In addition, the vent inlet 64 is in direct contact and interfaces with the ink retaining member 46. At the vent inlet, the ink retaining material 46 should have no cracks or wrinkles so that any air received from the air inlet 32 passes through the ink retaining member 46 and not through air space unoccupied by the ink retaining member 46.

FIG. 2 illustrates the cartridge 10 filled with ink 48 contained in the second chamber 42 and ink 56 contained in the ink retaining member 46 of the first chamber 40. The printhead 18 is not shown. The ink 48 fills a portion of the second chamber 42 above the surface of which is located in an air space. When the cartridge is not printing, ink levels in the first chamber 40 and the second chamber 42 reach a static condition. The ink retaining material 46 creates a certain amount of back pressure for the printhead 18 thereby preventing ink from leaving the ink retaining material 46 and escaping through the nozzles of the printhead 18 or from the cartridge 10 when not coupled to the printhead. An ink level 68 of the ink 56, as illustrated, equilibrates to a certain level with respect to the amount of ink contained in the housing and the amount of atmospheric pressure. The ink retaining material 46, also provides a space into which ink can enter during changes in atmospheric pressure. Consequently, the ink retaining material 46 should be larger than the anticipated amount of ink which can flow into the ink retaining material 46 under atmospheric pressure changes and typically a certain amount of ink retaining material will remain dry under most atmospheric conditions. The ink retaining material 46 also, of course, acts as an ink storage location which typically comprises approximately 33% of the total ink storage when the cartridge 10 is filled to capacity. Additionally, because the vent inlet 64 is sealed by the ink supply 56, no air enters the second chamber 42 via the passageway 62 thereby prohibiting ink flow through the lower port 50 into the ink retaining material 46.

Figure 3:
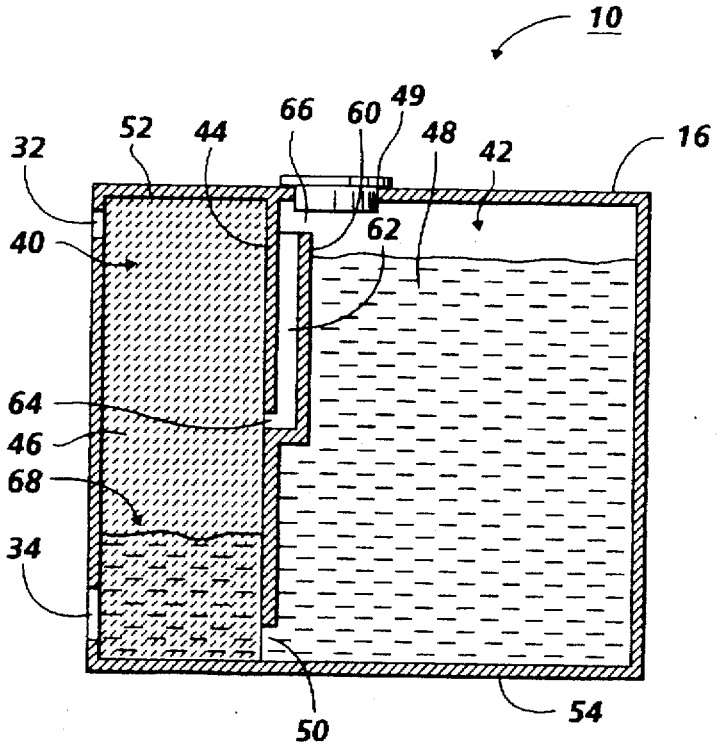
FIG. 3 is a sectional elevational view of the printhead cartridge of FIG. 2 showing an ink level during a particular time of a print operation.

When ink is removed during printing, the ink retaining material 46 becomes desaturated thereby opening the vent inlet 64 as illustrated in FIG. 3. Once the vent inlet 64 is opened, air passing through the air inlet 32 enters the vent inlet 64, travels through the passageway 62, through the vent outlet 66, and into the second chamber 42 above the level of the ink 48. Due to increasing air pressure in the second chamber 42, ink enters into the first chamber 40 from the second chamber 42 through the lower port 50 and begins again to saturate the ink retaining material 46. Once the level of the ink in the ink retaining material 46 reaches the interface between the vent inlet 64 and the ink retaining material 46, as shown in FIG. 2, no more air enters the passageway 62. At this time, no more air flows from the first chamber 40 into the second chamber 42 until the ink level is reduced below the vent inlet 64 at which time the same sequence of events occurs again. This cycle continues until the cartridge 10 is substantially empty of ink.

It is also possible that a certain amount of ink can collect in the passageway 62 particularly before the first use of the cartridge. If so, ink collected therein is pushed up through the air outlet 66 into the second chamber 42 during refill of the ink retaining material 46.

The continuous desaturation and saturation of the ink retaining material 46 with ink received from the second chamber 42 provides a more uniform back pressure to the printhead 18 than conventional cartridges with bubbler systems. For instance, in a bubbler system, the pressure within the system does not equalize until an air bubble has formed and passed into the supply of ink. Such a system experiences a series of pressure spikes, each spike increasing in amplitude until the bubble has formed. In addition, at higher flow rates, bubblers can experience foaming of the ink which means that less ink is available from the cartridge for printing. In contrast, the back pressure within the cartridge of the present invention is maintained at a fairly consistent level throughout the life of the cartridge. Such a system can potentially provide better printing than cartridges of the bubbler type. Since drop volume at the ink nozzles can change with variations in back pressure, a system having a consistent back pressure provides more consistent printing. The present system can be likened to taking sips of air as opposed to taking gulps of air to maintain a more consistent back pressure.

Figure 4:
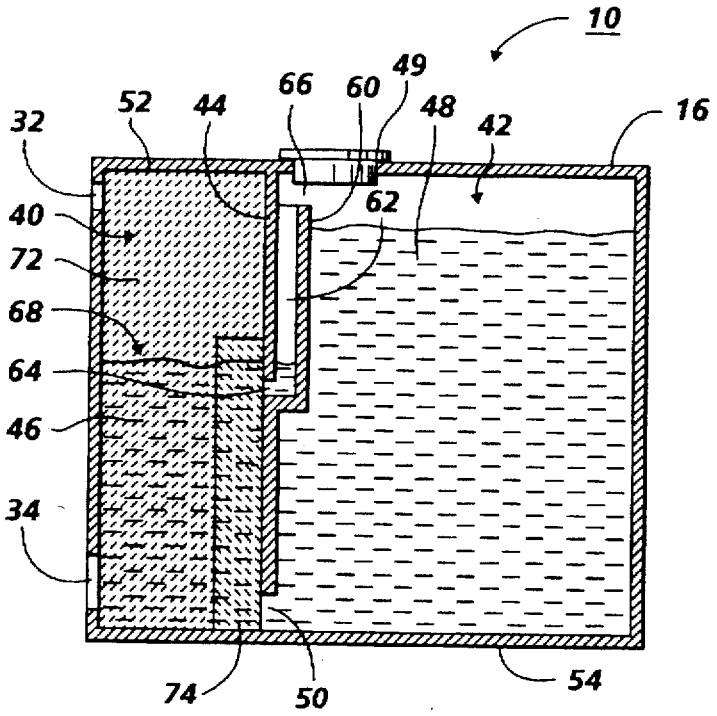
FIG. 4 is a sectional elevational view of another embodiment of a printhead cartridge of the present invention.

FIG. 4 illustrates another embodiment of the present invention. Instead of having a single piece of foam located within the first chamber 40, the first chamber 40 contains two pieces of ink retaining material, a first member 72 and a second member 74. The first member 72 consists of a low capillarity foam with respect to the material of the second member 74 which consists of a relatively high capillarity foam. The second member 74 consisting of the high capillarity foam connects the low capillarity foam 72 to the second chamber 42 thereby sealing the lower port 50 more efficiently. Higher capillarity foams have more pores per inch than lower capillarity foams. In addition, the high capillarity foam of the second member 74 also regulates the air release or valving into the second chamber 42 more efficiently during printing because of its high capillarity. When ink is drawn by the printhead 18 from the first chamber 40, the high capillarity foam 74 slightly desaturates and then quickly saturates to close off the air flow traveling through the vent inlet 64, thereby filling the first chamber 40 at a faster rate than possible with a one-piece foam. Even though an equally saturated higher capillarity foam draws liquid from a lower capability foam, the balanced saturation levels are such that the nozzles have sufficient capillarity to draw ink from the first foam member, since the first foam member has sufficient capillarity to draw ink from the highly saturated second foam member.

The combination of high capillarity foam and low capillarity foam also produces a more uniform back pressure. Compared to a bubbler type of system, the frequency of air sips through the vent inlet 64 and fluid dumps into the first chamber 40 through the first port 50 increases. The amount of fluid transferred per fluid dump, however, decreases. Consequently, the cartridge 10 illustrated in FIG. 4 gives improved control over back pressure due to the quicker cycling of air sips and fluid dumps. Additionally, selection of foam types having different capillarities provides a larger matrix of combinations and back pressures to choose from.

The dual foam system provides improved portability because the high capillarity foam located adjacently to the lower port 50 remains fully saturated in a static condition when tipped in any orientation thereby causing the ink to be airlocked within the cartridge 10.

The present invention using a single foam system or using a two foam system are improved systems over the bubbler type system. In the present invention, once the substantial majority of ink has been removed from the ink cartridge, the back pressure dies more quickly when compared to a bubbler type of system. When back pressures die slowly, the ink nozzles of the printhead are more likely to ingest air over a longer period of time thereby causing printing problems which may not be immediately noticeable. However when a system dies quickly, the ink ejecting nozzles are more likely to receive a sufficient supply of ink followed almost immediately by a supply of air. This causes the printhead nozzles to die very quickly thereby giving a better indication to an operator that the cartridge needs to be changed.

Figure 5:
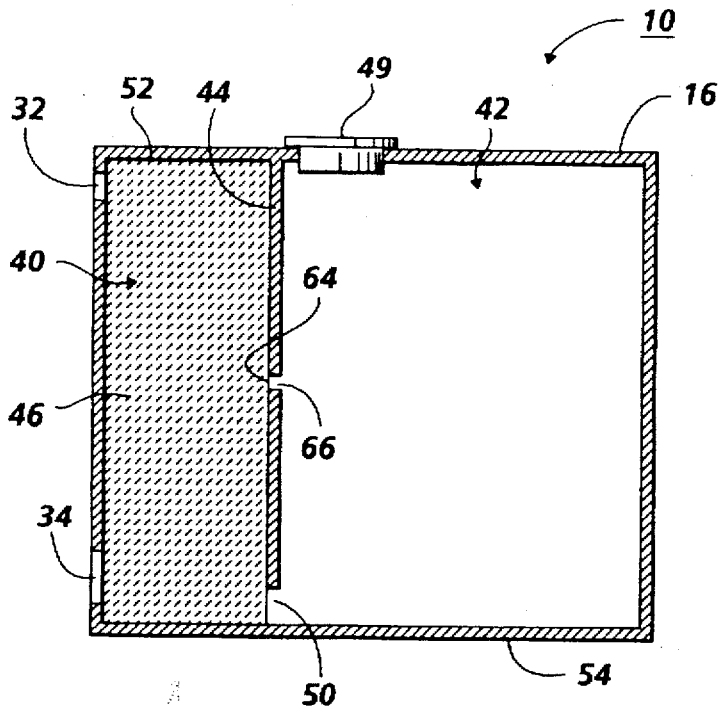
FIG. 5 is a sectional elevational view of another embodiment of a printhead cartridge of the present invention.

FIG. 5 illustrates an additional embodiment of the present invention in which the directing member 60 is absent. The vent inlet 64 and vent outlet 66 are not separated by a length of the passageway 62 which in other embodiments directed the transfer of air to a point above the ink 48 throughout the lifetime of the cartridge. In this instance, any air released into the chamber 48 must travel through the ink 48 until the level of the ink 42 falls below the vent inlet 64/vent outlet 66.

Figure 6:
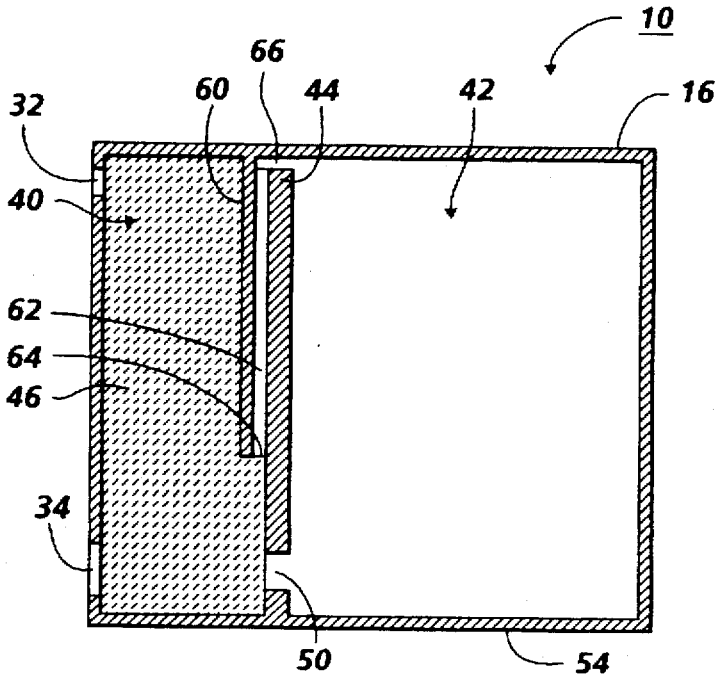
FIG. 6 is a sectional elevational view of another embodiment of a printhead cartridge of the present invention.

FIG. 6 illustrates another embodiment of the present invention in which the directing member 60 is located within the first chamber 40. This embodiment requires that the foam 46 be cut to fit around the directing member 60, since compression of the foam is not desirable.

In recapitulation, there has been described an ink jet printhead cartridge having a fluid valved breather which maintains a continuous supply of ink to an ink jet printhead having a consistently applied back pressure to the nozzles. It is, therefore, apparent that there has been provided in accordance with the present invention, a printhead cartridge that fully satisfies the aims and advantages hereinbefore set forth. While this invention has been described in conjunction with a specific embodiment thereof, it is evident that many alternatives, modifications, and variations will be apparent to those skilled in the art. For instance, the present invention is not limited to one or two member foam systems, but more than two foam members having different capillarities may be used. Additionally, the second chamber 42 need not be substantially free of an ink retaining member. Likewise, while the present invention has been described with reference to a cartridge-type printer, the present invention could also be used with print bars, such as used in page-width printers. Accordingly, it is intended to embrace all such alternatives, modifications and variations that fall within the spirit and broad scope of the appended claims.

What is claimed is:

1. An ink supply cartridge, comprising:

a housing having an interior space, said housing including a floor and a wall extending from said floor, said wall including an air inlet to transfer air into said housing and being in communication with the interior space, said air inlet located a first distance measured perpendicularly from said floor, said wall further including an ink outlet in communication with the interior space, said ink outlet located closer to said floor than said air inlet;

a dividing member, disposed in the interior space, contacting said housing, and defining therein a first chamber and a second chamber, said first chamber coupled to said air inlet and to said ink outlet, said dividing member including a vent inlet located a second distance measured perpendicularly from said floor, the second distance being less than the first distance;

a vent tube, disposed in the interior space, including a vent outlet and a passageway, said passageway extending between said vent outlet and said vent inlet, said vent outlet communicating with the second chamber and being located a third distance measured perpendicularly from said floor, the third distance being greater than the second distance, said vent tube passing air from the first chamber through said vent inlet, said passageway, and said vent outlet to communicate said air from the first chamber to the second chamber;

an ink inlet, spaced apart from said vent inlet and located between said first chamber and said second chamber, so as to supply an ink located in said second chamber to said first chamber and to prevent air from directly passing through said ink located in the second chamber; and an ink retaining member disposed in the first chamber, said ink retaining member receiving said ink from the second chamber and releasing said ink received from said second chamber to said ink outlet.

2. The ink supply cartridge of claim 1, wherein said ink retaining member covers said ink inlet.

3. The ink supply cartridge of claim 2, wherein said ink retaining member covers said ink outlet.

4. The ink supply cartridge of claim 3, wherein said ink retaining member covers said air inlet.

5. The ink supply cartridge of claim 1, wherein said ink retaining member includes a first capillary material and a second capillary material different than said first capillary material.

6. The ink supply cartridge of claim 5, wherein said first capillary material has a greater capillary action than said second capillary material.

7. The ink supply cartridge of claim 6, wherein said first capillary material covers said vent inlet.

8. The ink supply cartridge of claim 7, wherein said first capillary material covers said ink inlet.

9. An ink supply cartridge, comprising:

a housing having an interior space, said housing including a floor, a front wall, a back wall, a first side wall, and a second side wall, said front wall, said back wall, said first side wall, and said second side wall each extending from said floor, said first side wall and said second side wall coupled to said front wall and said back wall, said front wall including an air inlet and an ink outlet, in communication with the interior space;

a dividing member, disposed in the interior space and coupled to said first side wall and to said second side wall to define a first chamber and a second chamber within said housing, said first chamber coupled to said air inlet and said ink outlet, the second chamber holding ink, said dividing member including a vent tube, disposed in the second chamber, said vent tube including a vent inlet located a first distance measured perpendicularly from said floor and a vent outlet located a second distance measured perpendicularly from said floor, the second distance being greater than the first distance, said vent tube further including a passageway extending between said vent inlet and said vent outlet, said vent tube connecting the first chamber to the second chamber to transfer air from the first chamber through said vent inlet, said passageway, and said vent outlet to communicate said air from the first chamber to the second chamber through said vent tube;

an ink inlet spaced apart from said vent inlet and located between said first chamber and said second chamber, so as to supply said ink from said second chamber to said first chamber and to prevent air from directly passing through said ink located in the second chamber; and an ink retaining member disposed in the first chamber, said ink retaining member receiving said ink from the second chamber and releasing said ink received from said second chamber to the ink outlet.

10. The ink supply cartridge of claim 9, wherein said vent tube includes a diameter of less than 2 millimeters.

11. The ink supply cartridge of claim 10, wherein said vent tube includes a diameter of greater than 1.6 millimeters.

12. The ink supply cartridge of claim 9, wherein the second chamber is larger than the first chamber.

13. An ink jet printer for printing on a recording medium, comprising:

an ink supply cartridge having a housing, said housing having an interior space, said housing including a floor and a wall extending from said floor, said wall including an air inlet to transfer air into said housing and being in communication with the interior space, said air inlet located a first distance measured perpendicularly from said floor, said wall further including an ink outlet in communication with the interior space, said ink outlet located closer to said floor than said air inlet, a dividing member, disposed in the interior space, contacting said housing and defining therein a first chamber and a second chamber, said first chamber coupled to said air inlet and said ink outlet, said dividing member including a vent inlet located a second distance measured perpendicularly from said floor, the second distance being less than the first distance, a vent tube, disposed in the interior space, including a vent outlet and a passageway, said passageway extending between said vent outlet and said vent inlet, said vent outlet communicating with the second chamber and being located a third distance measured perpendicularly from said floor, said third distance being greater than said second distance, said vent tube passing air from the first chamber through said vent inlet, said passageway, and said vent outlet to communicate said air from the first chamber to the second chamber, an ink inlet spaced apart from said vent inlet and located between said first chamber and said second chamber, so as to supply an ink located in said second chamber to said first chamber and to prevent air from directly passing through said ink located in the second chamber, and an ink retaining member disposed in the first chamber, said ink retaining member receiving said ink from the second chamber and releasing said ink received from the second chamber to the ink outlet;

a printhead coupled to said ink outlet of said ink supply cartridge; and a frame supporting said printhead in spaced relationship with the recording medium.

* * * * *